United States Patent [19]

Tait et al.

[11] Patent Number: 4,668,293

[45] Date of Patent: May 26, 1987

[54] PHYTATE CORROSION INHIBITOR SYSTEM

[75] Inventor: W. Stephen Tait; Donald C. Liebe, both of Racine County. Wis.

[73] Assignee: S. C. Johnson & Son, Inc., Racine, Wis.

[21] Appl. No.: 832,564

[22] Filed: Feb. 24, 1986

[51] Int. Cl.[4] ..... C04B 9/02

[52] U.S. Cl. ..... 106/14.12; 106/14.13; 106/14.41; 252/396; 424/70

[58] Field of Search ..... 106/14.12, 14.13, 14.41; 252/396; 424/70

[56] References Cited

U.S. PATENT DOCUMENTS 3,769,068 10/1973 Yamagishi et al. .

4,089,795 5/1978 Bailey et al. ..... 252/135

OTHER PUBLICATIONS

Ernst Graf, Applications of Phytic Acid, JOASC, vol. 60, No. 11, Nov. 1983, pp. 1861–1865.

*Primary Examiner*—Lorenzo B. Hayes

[57] ABSTRACT

A corrosion inhibitor system and method for inhibiting corrosion in aqueous compositions within aerosol containers. The composition comprises at least one Group I metal salt of benzoic acid and at least one phytate selected from the group consisting of Group I and Group II metal salts of phytic acid and mixtures thereof, when the ratio of benzoate to phytate is about 10:1 to 1:10 and preferably 2.5:1, the corrosion inhibitor system being present in an amount of about 0.1 to 4% by weight of the composition. The method comprises adding an effective amount of at least one Group I metal salt of benzoic acid and at least one phytate selected from the group consisting of Group I and Group II metal salts of phytic acid and mixtures thereof to reduce corrosion in steel aerosol containers containing corrosive aqueous compositions. The ratios of benzoate to phytate are effective to inhibit corrosion in the aqueous system.

16 Claims, 1 Drawing Figure

PHYTATE CORROSION INHIBITOR SYSTEM

BACKGROUND OF THE INVENTION

1. Field Of The Invention

This invention relates to a benzoate-phytate corrosion inhibitor system for tinplated steel aerosol containers. It has been discovered that a 0.4 to 1% concentration of 2.5:1 mixture of sodium benzoate and sodium phytate effectively inhibits corrosion of tinplate aerosol cans by hair styling foams which have hitherto been packaged in expensive aluminum aerosol containers and other formulations which are too corrosive to be packaged in unlined tinplated aerosol containers.

2. Description Of The Prior Art

Yamagishi et al., U.S. Pat. No. 3,769,068 relates to a method or process for coating steel plates with aluminum to render the steel plates corrosion resistant. The process includes making a slurry of aluminum powder and water and coating a pretreated steel plate with the slurry to prevent rusting of the underlying steel plate. The aluminum slurry powder is premade and stored for some time before coating. Therefore, there is a possibility that the aluminum powder in the slurry will react with water to make the slurry difficult or impossible to use. To prevent the reaction between the aluminum powder and the water, stabilizing agents including phytic acid are added to the slurry to prevent a chemical reaction between the aluminum and the water and to stabilize the slurry for long periods of time during which it may be stored before coating the steel plate.

In addition, Yamagishi teaches that as a steel strip is fed at slow speeds, under foundry conditions, rust may generate on the strip during the process time between the coating of the steel which the slurry and the final drying of the product. It has been found that this rust is effectively prevented by the addition of a corrosion inhibitor such as sodium nitrite and sodium benzoate. As the steel strip is subject to degreasing with alkali cleaners and water scrubbing whereby oxidation conditions are present, rust can form on the steel plate. The steel plate is also subject to heat in order to rapidly dry the surface and presumably prevent rusting. However, as is well known, surface rust may appear where drying is not complete and indeed, be facilitated in its formation by the application of heat to dry the steel.

Important differences exist between teachings of Yamagishi and the present invention. Specifically, Yamagishi is concerned with the adherence of an aluminum slurry to a steel plate. Moreover, the steel plate itself is treated for rust inhibition while it is heated and under wet conditions so that rust will not form underneath the slurry and impede the adherence of the slurry to the metal plate. In addition, Yamagishi uses phytic acid (instead of its group I metal salt) which we have found does not work as a corrosion inhibitor for tinplate aerosol cans. No mention is made, and none can be seen, of using a sodium phytate and sodium benzoate combination to prevent a corrosive aerosol composition from corroding through a tinplated metal container.

More particularly, it is not seen in Yamagishi to use a specific ratio of sodium phytate and sodium benzoate to prevent a corrosive aerosol composition contained within a tinplated steel container from reacting with exposed metal ions along the seam of the can to prevent failure of the container. Accordingly, the present invention differs from Yamagishi.

Graf. JAOCS, Vol. 60, No. 11 (November, 1983) page 1861 at 1863–65 discloses the use of various salts of phytic acid as corrosion inhibitors on tin plates and cans. Graf states cans treated with phytic acid salts show good oxidation, corrosion and scratch resistance, good solderability, resistance toward blackening by sulfur and superior appearance.

The Graf article does not discuss the synergism of sodium phytate and sodium benzoate in a 2.5:1 ratio to inhibit corrosion of the metal seam of a tin plated steel container by a corrosive aerosol composition. Accordingly, the present invention differs from the Graf articles.

SUMMARY OF THE INVENTION

The present invention is a 2.5 to 1 ratio of sodium benzoate to sodium phytate at about 0.4 to 1% levels to provide corrosion protection in tinplated steel containers containing corrosive aerosol formulas which had previously been thought to be packaged only in expensive aluminum containers or tin plated steel aerosol containers that have been internally coated with an organic polymer such as is known in the art. It is believed that the Group I metal salts of benzoic acid, and specifically sodium or potassium benzoate are employed to form a benzoate chemisorbed film on the tin plated steel surface to form a protective film on the steel of an aerosol container which inhibits the aqueous corrosion of the container. A Group I or Group II metal salt of phytic acid, such as sodium or potassium phytate, but also magnesium, calcium or barium phytate unexpectedly synergistically interacts with the benzoate film and stabilizes the film against degradation.

DETAILED DESCRIPTION OF THE PREFERRED EMBODIMENTS

Figure 1:
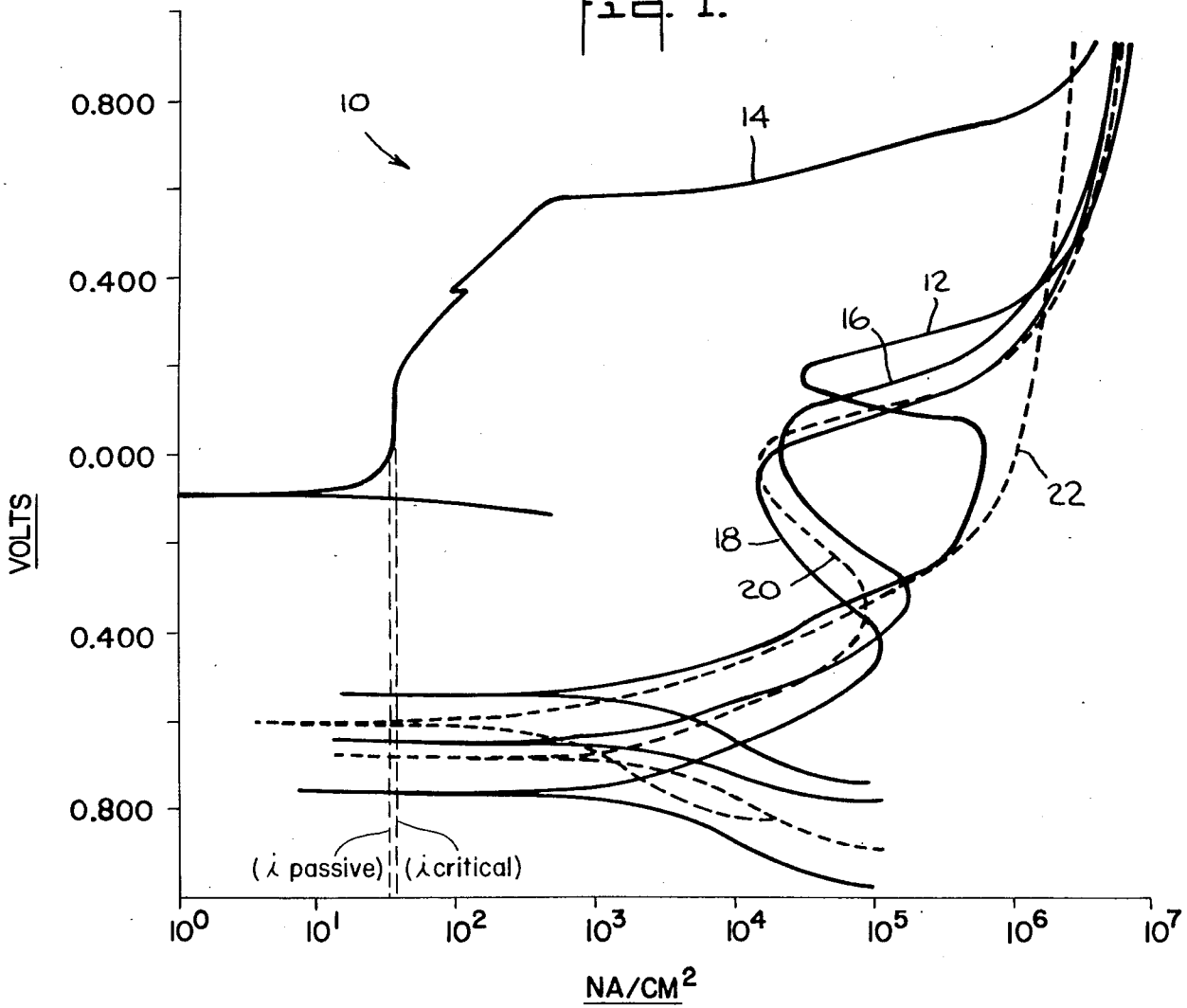
FIG. 1 depicts a number of curves generated by an electrochemical corrosion test for tin plated steel aerosol containers.

This invention relates to a benzoate phytate corrosion inhibitor mixture for tin plate steel containers. It has been discovered that about 0.4 to 1% concentration of 2.5:1 mixture of sodium benzoate with sodium phytate effectively inhibits corrosion of tin plate aerosol containers containing aqueous formulations.

The base steel of a tin plated container is believed to be chemically attacked by one of the two following chemical reactions:

$$2Fe+O_2+2H_2O \rightarrow 2Fe(OH)_2$$

$$Fe+2(HX)._nH_2O \rightarrow (Fex_2)._nH_2O$$

where X represents a negatively charged counter ion such as Cl- and n is a number.

It has been been unexpectedly discovered that a synergism exists between Group I or II metal phytate and Group I metal benzoate when the benzoate to phytate is present in a ratio of about 10:1 to 1:1 and preferably, in a ratio of about a 2.5:1, when the benzoate/phytate corrosion inhibitor system is present in an amount of about 0.1 to 4% by weight of the aqueous composition and most preferably present at about 0.4 to 1% by weight of the composition.

The corrosion inhibitor system is very dependent upon the ratio of benzoate to phytate because it has been determined that outside an optium ratio of benzoate to phytate, i.e. about 2.5:1, the anticorrosive properties of the system are reduced. Indeed, at much beyond the 10:1 to 1:10 benzoate to phytate, the system exhibits substantially diminished corrosion inhibition.

The corrosion inhibitor system of the present invention is adapted to form a stable passivating film on the tin plated or tin free steel aerosol containers. In general, all aqueous compositions in steel aerosol containers are suitable for use with the corrosion inhibitor system of this invention. Moreover, the system is not pH sensitive and will work in all kinds of aqueous systems.

Finally, it is contemplated that a combination of Group I metal benzoates and a combination of the Group I and Group II phytates at the specific ratios will inhibit the corrosion process.

FIG. 1 depicts curves from an electrochemical corrosion test on aerosol container steel that is exposed to corrosive aqueous composition. The curves 10 are plotted as potential vs. current. Curve 12 demonstrates the active-passive corrosion behavior of the container when the benzoate to phytate ratio is 1:1 at a 1% concentration by weight of the solution. The same concentration was used for all the curves where the corrosion inhibitor system is depicted. The curve 12 indicates that the current density (i critical) is too high for spontaneous passivation to occur. Those skilled in the art will appreciate that in this case, tin has a more positive open circuit potential (O.C.P.) than steel, and thus will galvanically accelerate steel corrosion wherever steel is exposed through pores in the tin coating. Although some inhibition is detected, this ratio is not optimum for reducing the aqueous corrosion process.

Curves 16, 18 and 20 depict the electrochemical corrosion when the benzoate/phytate ratios are 5:1, 7.5:1 and 10:1 respectively. It should be noted that although some corrosion inhibition is seen, it is similar to the corrosion inhibition of curve 12.

Curve 22 depicts the corrosion of the container when no benzoate/phytate corrosion inhibitor is present. Those skilled in the art will appreciate that corrosion as depicted by this curve will result in failure of the container within a relatively short time.

Curve 14 depicts the electrochemical corrosion of the tin plated steel container when a 2.5:1 ratio of benzoate/phytate is present as a corrosion inhibitor. The curve depicts the spontaneous passivation of the steel. Tin, in this case, had a more negative open circuit potential than the steel and also had spontaneous passive corrosion behavior. As the curve indicates, the current density (i passive) is low enough such that an extended container service life can be expected.

The corrosion inhibitor system of the present invention inhibits corrosion, it is postulated, by forming a passivating film over the surface of iron to prevent corrosion. It has been unexpectedly found that a Group I metal benzoate and a Group I, or II or mixtures thereof, of a metal phytate are unexpectedly effective in the ratios of about 10:1 to about 1:1 and preferably about 2.5:1 when present in the system at about 0.1 to 4% by weight of the composition and preferably at about 0.4 to 1% by weight of the composition. This synergism has only been observed between at least one Group I metal benzoate and at least one Group I, Group II, or mixtures thereof of metal phytate. Other combinations such as sodium hexametaphosphate and sodium benzoate, or sodium orthophosphate and sodium benzoate, or sodium citrate and sodium phytate have been found to have less corrosion inhibition capability.

In addition, to inhibiting the corrosion of steel, this inhibitor system prevents tin from galvanically corroding the steel by shifting its open circuit potential to a more negative value than the steel's, and also inhibits the corrosion of the tin. This is important since the presence of tip ions in a solution can make the products performance degrade to an unexceptable level.

It is believed that any Group I metal salt of benzoic acid will form a protective chemisorbed film on tin plate or tin free steel. Additionally, a Group I or II metal salt of phytic acid, or combinations thereof, will synergistically interact with the benzoate film to stabilize the film thereby giving unexpectedly improved aqueous corrosion inhibition.

The following is an example of the use of the corrosion inhibitor system of the present invention in an aqueous composition which is representative of those solutions which would use the inhibitor system. The example is offered to illustrate the synergistic effects of the sodium benzoate to sodium phytate and is not to be construed as limiting the scope and spirit of the invention.

EXAMPLE I

| INGREDIENT | PERCENT BY WEIGHT |
|---|---|
| Deionized water | 86.69 |
| KATHON CG | 0.01 |
| Variquat E228 | 3.00 |
| KEMAMINE BQ 2982-B | 0.50 |
| Copolymer 845 | 8.00 |
| Fragrance | .80 |
| Corrosion Inhibitor System (2.5:1 Benzoate/Phytate) | 1.00 |

Key To Example I

KATHON CG is methylchloroisothiozolinone and methylisothiazolinone (1.5% by weight)

Variquat E228 is centrimonium chloride

KENAMINE BQ 2982-B is erucyldimethyl benzyl ammonium chloride (50% by weight)

Copolymer 848 is vinyl pyrrolidone/dimethyl aminoethylmethacrylate copolymer (20% by weight)

The amount of water in the test formula was varied to accomodate corrosion inhibitor concentrations varying from 0.5 to 3%. A test cell was charged with the test formula and the corrosion inhibitor efficacy determined by an electrochemical potentiodynamic scanning method. The procedure generates a potential vs. current curve obtained by applying an increasing potential to a test metal electrode which is submerged in the test fluid under consideration. The results indicated that there was a loss of chemical reactivity, probably due to the formation of a passive film on the metal surface which is termed specimen passivation.

I claim:

1. A corrosion inhibitor system for aqueous compositions in steel or tinplated steel aerosol containers, comprising:

(a) at least one Group I metal salt of benzoic acid, and;

(b) at least one phytate selected from the group consisting of Group I and Group II metal salts of phytic acid, and mixtures thereof; wherein the ratio of (a) to (b) is about 10:1 to 1:10, said corrosion inhibitor system present in an amount of about 0.1 to 4% by weight of the aqueous composition and whereby the corrosion inhibitor system effectively inhibits corrosion of said aerosol containers by formulations which are too corrosive to be packaged in said aerosol containers without the corrosion inhibitor system.

2. The corrosion inhibitor system of claim 1, wherein the ratio of (a) to (b) is about 2.5 to 1, said system present at about 0.4 to 1% by weight of the composition.

3. The corrosion inhibitor system of claim 1, wherein (a) is sodium benzoate and (b) is sodium phytate.

4. A method for reducing corrosion in a steel or tinplated steel aerosol container containing a corrosive aqueous composition comprising:

(a) adding an effective amount of at least one Group I metal salt of benzoic acid, and;

(b) an effective amount of at least one phytate selected from the group consisting of Group I and Group II metal salts of phytic acid, and mixtures thereof wherein the ratio of (a) to (b) is effective to inhibit corrosion in an aqueous system which is too corrosive to be packaged in said aerosol containers.

5. The method of claim 4, wherein the ratio of (a) to (b) is 10:1 to 1:1.

6. The method of claim 4, wherein (a) and (b) are present from about 0.1 to 4% by weight of the composition.

7. The method of claim 4, wherein (a) is sodium benzoate and (b) is sodium phytate.

8. The method of claim 4, wherein the ratio of (a) to (b) is 2.5:1, and the concentration of (a) and (b) is about 0.4 to 1% by weight of the composition.

9. A corrosion inhibitor system for hair styling foam compositions packaged in aerosol containers, comprising:

(a) at least one Group I metal salt of benzoic acid, and;

(b) at least one phytate selected from the group consisting of Group I and Group II metal salts of phytic acid, and mixtures thereof;

wherein the ratio of (a) to (b) is about 10:1 to 1:10, said corrosion inhibitor system present in an amount of about 0.1 to 4% by weight of the aqueous composition.

10. The corrosion inhibitor system of claim 9, wherein the ratio of (a) to (b) is about 2.5 to 1, said system present at about 0.4 to 1% by weight of the composition.

11. The corrosion inhibitor system of claim 9, wherein (a) is sodium benzoate and (b) is sodium phytate.

12. A method for reducing corrosion in a steel or tinplated steel aerosol container containing a corrosive hair styling foam composition comprising:

(a) adding an effective amount of at least one Group I metal salt of benzoic acid, and;

(b) an effective amount of at least one phytate selected from the group consisting of Group I and Group II metal salts of phytic acid, and mixtures thereof;

wherein the ratio of (a) to (b) is effective to inhibit corrosion in an aqueous system.

13. The method of claim 12, wherein the ratio of (a) to (b) is 10:1 to 1:1.

14. The method of claim 12, wherein (a) and (b) are present from about 0.1 to 4% by weight of the composition.

15. The method of claim 12, wherein (a) is sodium benzoate and (b) is sodium phytate.

16. The method of claim 12, wherein the ratio of (a) to (b) is 2.5:1, and the concentration of (a) and (b) is about 0.4 to 1% by weight of the composition.

* * * * *

UNITED STATES PATENT AND TRADEMARK OFFICE

CERTIFICATE OF CORRECTION

PATENT NO. : 4,668,293

DATED : May 26, 1987

INVENTOR(S) : W. Stephen Tait & Donald C. Liebe

It is certified that error appears in the above-identified patent and that said Letters Patent is hereby corrected as shown below:

In column 1, line 36, please delete "which" and substitute therefor --with--.

In column 2, line 61, please delete "1:1" and substitute therefor --1:10--.

In column 3, line 59, please delete "1:1" and substitute therefor --1:10--.

Signed and Sealed this

Twelfth Day of July, 1988

*Attest:*

DONALD J. QUIGG

*Attesting Officer*

*Commissioner of Patents and Trademarks*